United States Patent [19]

Mucaro

[11] 4,423,871

[45] Jan. 3, 1984

[54] TOY VEHICLE GAME

[75] Inventor: Salvatore A. Mucaro, Maywood, N.J.

[73] Assignee: Ideal Toy Corporation, Hollis, N.Y.

[21] Appl. No.: 345,870

[22] Filed: Feb. 4, 1982

[51] Int. Cl.[3] ..... A63F 9/14

[52] U.S. Cl. ..... 273/86 R; 46/206; 46/1 K

[58] Field of Search ..... 46/206, 202, 201, 1 K, 46/209; 273/86 R, 86 C, 86 D, 121 R, 124 R, 129 P; 238/10 A, 10 B, 10 C, 10 E, 10 F

[56] References Cited

U.S. PATENT DOCUMENTS

| | | | |
|---|---|---|---|
| 1,958,563 | 5/1934 | Brooker et al. | 273/129 P X |
| 2,829,895 | 4/1958 | Moen | 124/10 X |
| 3,952,442 | 4/1976 | Livesey et al. | 46/206 |
| 4,249,733 | 2/1981 | Eddins et al. | 46/206 X |

FOREIGN PATENT DOCUMENTS

| | | | |
|---|---|---|---|
| 46213 | 3/1966 | German Democratic Rep. | 273/86 R |

*Primary Examiner*—Mickey Yu

*Attorney, Agent, or Firm*—Richard M. Rabkin

[57] ABSTRACT

The toy vehicle game includes a track, a toy vehicle for operation thereon, and a launcher for launching the vehicle to propel it along the track. The track includes a start position at which the launcher is located and an end position, located above the start position, whereby a vehicle launched onto the track at the start position traverses the track to the end position, above the start position. The track includes a pivoted section at the end position having a center of gravity located such that it normally is in a horizontal position but will pivot when the toy vehicle moves onto it, thereby to deposit the vehicle down onto the start position of the track and return it to the launcher for relaunching onto the track.

14 Claims, 8 Drawing Figures

TOY VEHICLE GAME

The present invention relates to toy vehicle games and more particularly to a toy vehicle game wherein toy vehicles are repeatedly launched onto the track after each traverse of the track.

Toy vehicle race games have been previously proposed in a variety of different types of constructions. Particularly popular are toy vehicle race games utilizing battery or electric powered toy vehicles in a continuous game. Such games, however, are relatively expensive to manufacture and sell and they further require careful maintenance during use. Other toy vehicle games utilize spring driven motors in order to simulate a continuous race but again these games are relatively expensive to manufacture and sell and require a certain amount of maintenance and/or repair.

It is an object of the present invention to provide a toy vehicle race game which is extremely simple in construction and operation.

Another object of the present invention is to provide a toy vehicle race game in which the vehicles are powered by the manual operation of a launcher.

Another object of the present invention is to provide a toy vehicle race game which is relatively simple in construction and inexpensive to manufacture.

A further object of the present invention is to produce a toy vehicle race game which is durable in construction.

In accordance with an aspect of the present invention a toy vehicle race game is provided which has a track that may be in the shape of an oval or a figure-8, or the like. The track has a plurality of walls that define at least two separate lanes on the track upon which the toy vehicles can independently operate. A pair of toy vehicle launchers are associated with the track lanes for separately and independently launching the respective toy vehicles onto their associated lanes.

The track includes a pair of start positions and a pair of end positions, one for each lane, with the end positions of the track being defined by ramp sections positioned to locate the end position above the start position in the respective track lanes. Each ramp section includes a pivotally mounted end track section which is balanced to be normally maintained in a horizontal position thereby to receive a toy vehicle entering from the ramp. The pivoted track section has an abutment which stops forward movement of a vehicle entering it. The balance of the pivoted track section is changed by the weight of the toy vehicle entering it so that it pivots downwardly when the vehicle is stopped on it to return the vehicle in a reverse direction downwardly back onto the start position of its associated lane and into the launcher. As a result, after each traverse of the track, the toy vehicles are automatically returned to their associated launchers which are manually operated by the players to relaunch the vehicles back onto the track. The launchers are constructed to cooperate with the toy vehicles to apply a squeezing force on wedge elements in the toy vehicles which will propel the vehicle in a forward direction about the track so that it will pass from the start position along the track back to the end position where it again returns to the launcher.

Toy vehicle launchers which apply a squeezing force to a toy vehicle have been disclosed in the past, such as, for example, in U.S. Pat. No. 3,952,442; but these launchers have not been used in toy vehicle race games which are constructed to automatically return the vehicle to the launcher. In addition, the construction shown in the above-mentioned patent requires that the toy vehicle have an unrealistic shape, since the body of the vehicle itself forms a surface upon which the squeezing force is applied. The construction of the present invention enables a toy vehicle to have a more realistic appearance and to enable automatic reengagement of the vehicle with the launcher without manual positioning of the vehicle by the players.

The above, and other objects, features and advantages of this invention will be apparent in the following detailed description of an illustrative embodiment which is to be read in connection with the accompanying drawings wherein.

Figure 1:
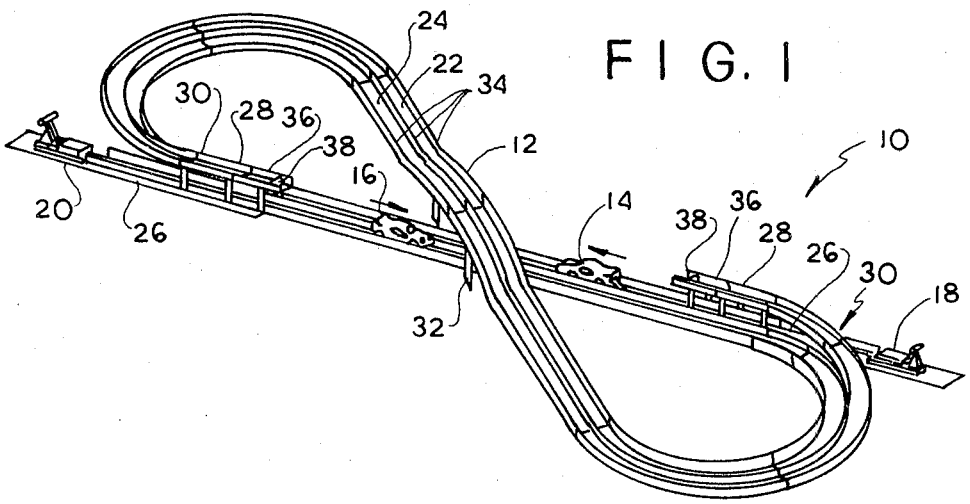
FIG. 1 is a perspective view of a toy vehicle constructed in accordance with the present invention.

Referring now to the drawings in detail, and initially to FIG. 1 thereof, a toy vehicle game 10 constructed in accordance with the present invention includes a track 12, a pair of vehicles 14, 16, and a pair of launchers 18, 20, respectively associated with each of the toy vehicles. The launchers are of essentially identical construction as described hereinafter.

Track 12 consists of a plurality of track sections interconnected in any convenient known manner. In the illustrative embodiment of the invention, the track is laid out in a figure-8 shape, however, other shapes such as ovals or multiple loops can be utilized instead. Regardless of the track arrangement, the track is constructed to provide a pair of separate and independent lanes 22, 24 in which the toy vehicles 14, 16, respectively and independently operate. Each lane has a start position 26, and an end position 28 located immediately above the start position. The end position of each lane is defined by a ramp section 30 which guides the toy vehicle to a position superimposed above the start position. In the illustrative embodiment, a central bridge arrangement 32 is provided to permit the track lanes to cross one another. By this construction, the track lanes have exactly the same length so that a toy vehicle race can be simulated. In the race, toy vehicles 14, 16 are launched by their respective launchers 18, 20 and propelled along their associated track lanes. The vehicles move along their lanes and are guided to the end sections 28 by sidewalls 34 formed along the track sections. At each end track section, a pivoted section 36 is provided which has an end abutment 38 that stops movement of the toy vehicle in the forward direction. This pivoted track section is normally in the horizontal position so that it can receive the toy vehicle from the ramp section of the track. When the vehicle enters the pivoted section 36, the weight of the vehicle causes the section to pivot downwardly so that the vehicle rolls under the force of gravity in the reverse direction down the pivoted track section and into its associated launcher which can then be operated to propel the toy vehicle again along the track. If desired, the launchers and/or the end track sections may include an automatic counter of any convenient construction (not shown) so that the players can keep count of the number of laps traversed by their toy vehicle. The first player to accumulate the preselected number of laps wins the race.

Figure 3:
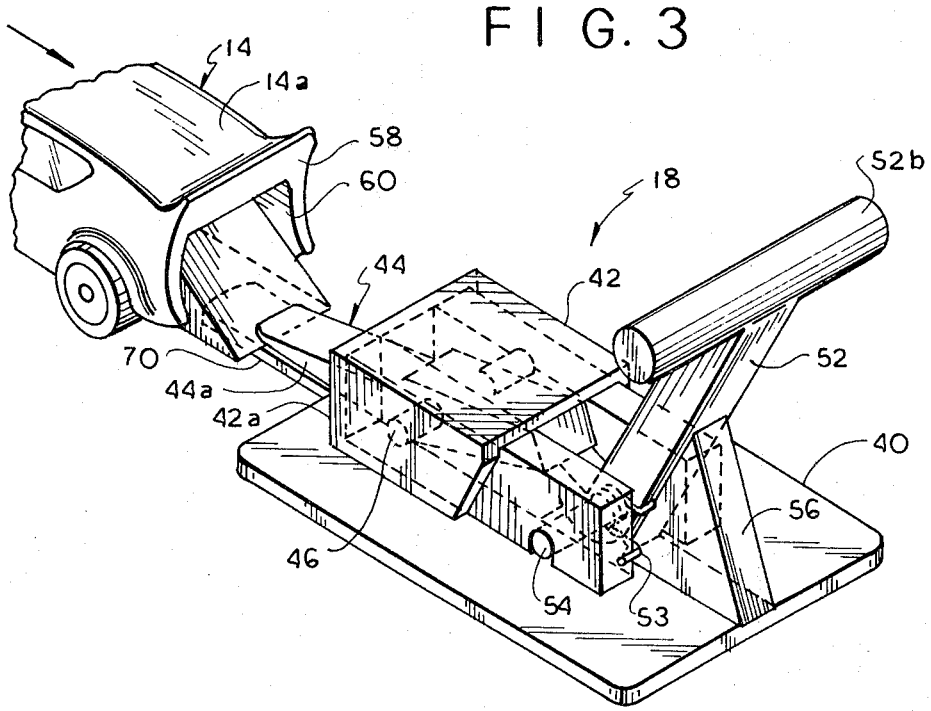
FIG. 3 is a further enlarged perspective view of the toy vehicle launcher used in the game of FIG. 1.
Figure 4:
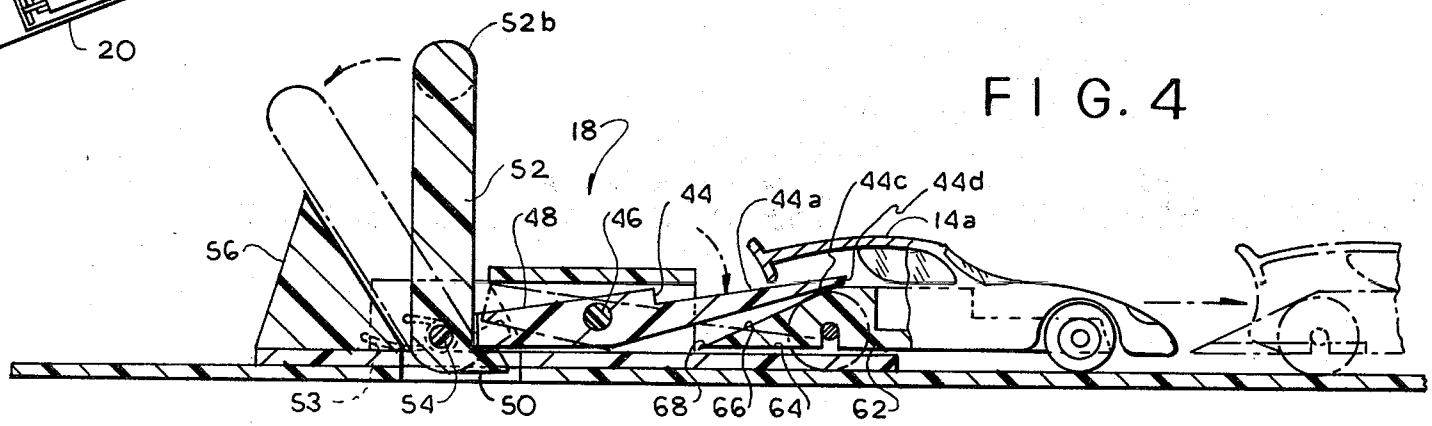
FIG. 4 is a partial longitudinal sectional view of the launcher and toy vehicle showing the launching operation.

The toy vehicle and launcher construction is shown more clearly in FIGS. 3 and 4. Since each of the launchers are identical in construction, only launcher 18 is illustrated and described in detail. As seen therein, the launcher includes a base plate 40 on which a housing 42 is secured. A first lever 44 is pivoted by a pair of pins 46 in housing 42. This lever has a first end portion 44*a* which is generally wedge shaped. The opposite end 48 of lever 44 is generally square in cross-section and engages the hook end 50 of a handle 52. The latter is pivotally mounted by a pin 54 in housing 42 with its pivotal movement being limited in the clockwise direction by an abutment 56 formed on base 40. End 52*b* of the handle is generally T-shaped to permit ready manual engagement by the player. Preferably, handle 52 is provided with a coil spring 53 wound about pin 54 and engaged between base 40 and handle 52 to normally bias the handle to its upright position shown in solid lines in FIG. 4.

Toy vehicle 14 (which is identical to toy vehicle 16 in construction) has a frame on which a plurality of wheels are rotatably mounted. The vehicle includes a body portion 14*a* which has a rear end 58 including an opening 60 formed therein. A drive wedge 62, formed of a low friction material, such as Tevlar or Teflon, is mounted within body 14*a* of the vehicle and may be formed as an integral part of the vehicle frame. The drive wedge includes a flat, lower surface 64 which extends generally parallel to the horizontal surface of the track, and an upper, downwardly inclined surface 66 which forms the driving surface of the wedge. Surfaces 64 and 66 meet at a pointed apex 68 located at opening 60 in the vehicle body.

Lever 44 is balanced or weighted such that it is normally in the dotted line position shown in FIG. 4, i.e. with its lower surface 44*c* engaged against the surface of base 40. Its forward end 44*d* defines an apex with a slight upward incline. By this construction, when the toy vehicle moves rearwardly toward the launcher, apex 68 of drive wedge 62 enters below tip 44*d* of lever 44 and urges the lever upwardly in a counterclockwise direction into the solid line position shown in FIG. 4. This causes the rear end 48 of lever 44 to move downwardly against tongue 50 of handle 52 which, as mentioned, is normally maintained in its upright solid line position, shown in FIG. 4, by spring 53.

Figure 2:
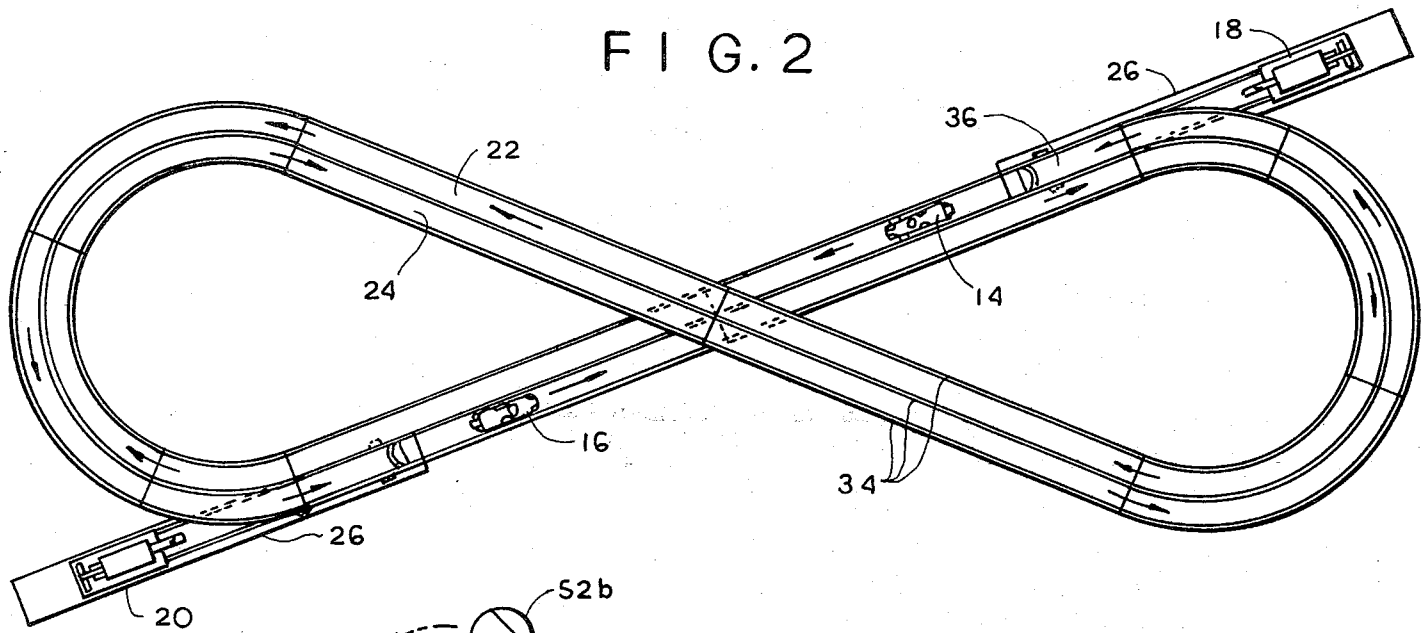
FIG. 2 is a plan view on an enlarged scale of the game shown in FIG. 1.
Figure 5:
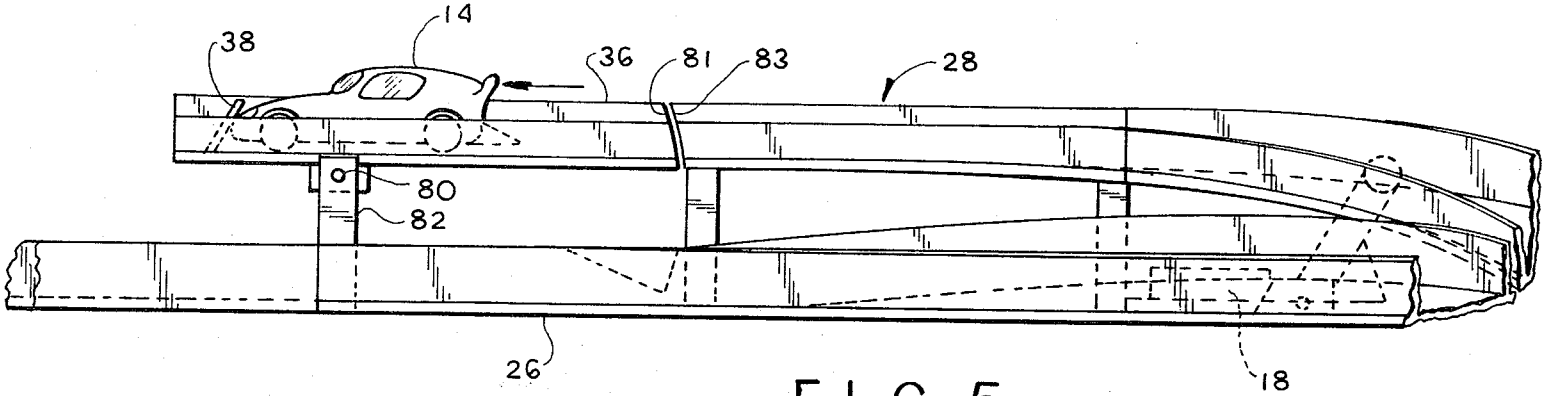
FIG. 5 is a side view of the superimposed end and start positions of one of the lanes of the toy vehicle game from one side thereof.
Figure 6:
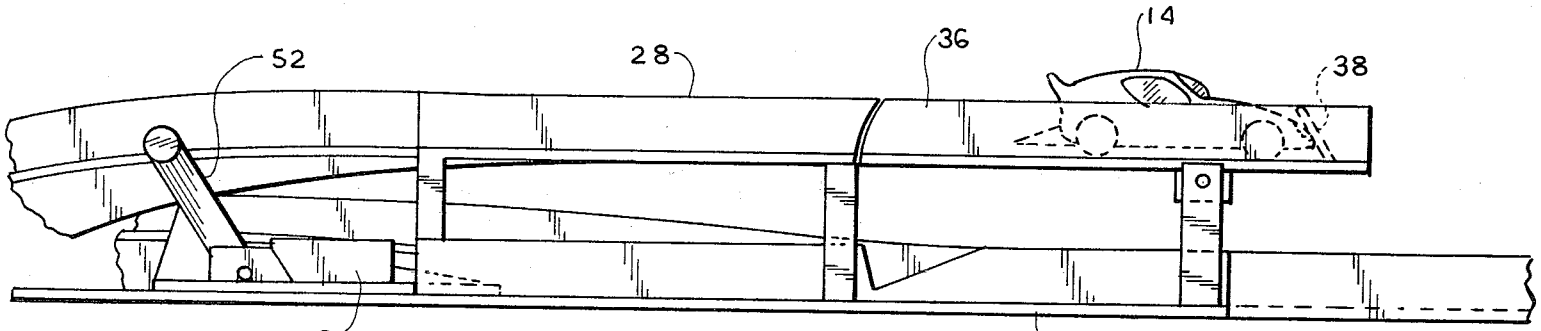
FIG. 6 is a side view similar to FIG. 5, but from the other side of the lane.
Figure 7:
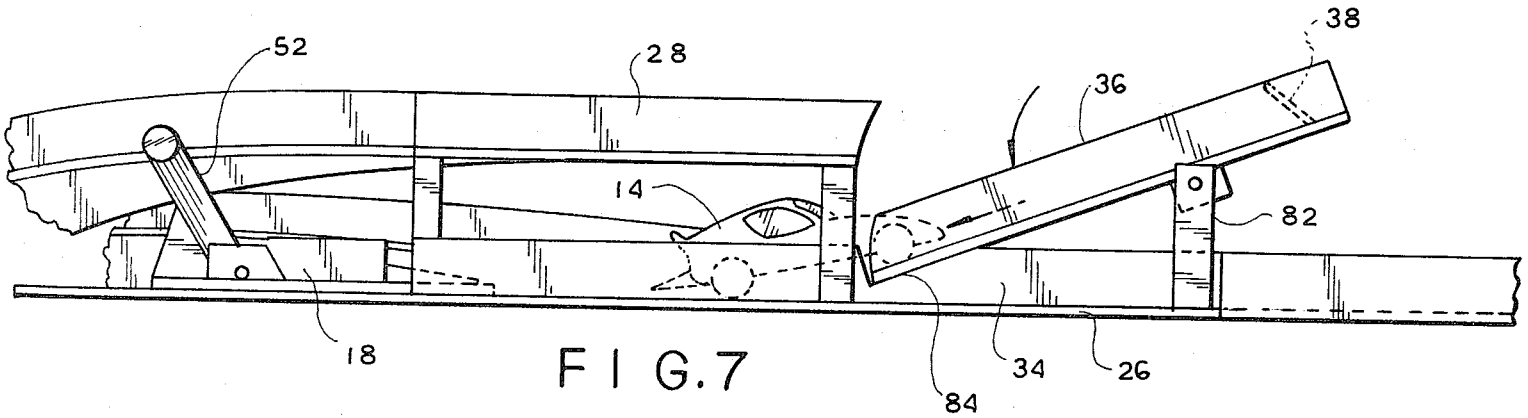
FIG. 7 is a side view similar to FIG. 6 showing the toy vehicle being returned to the launcher by the pivoted end track section.
Figure 8:
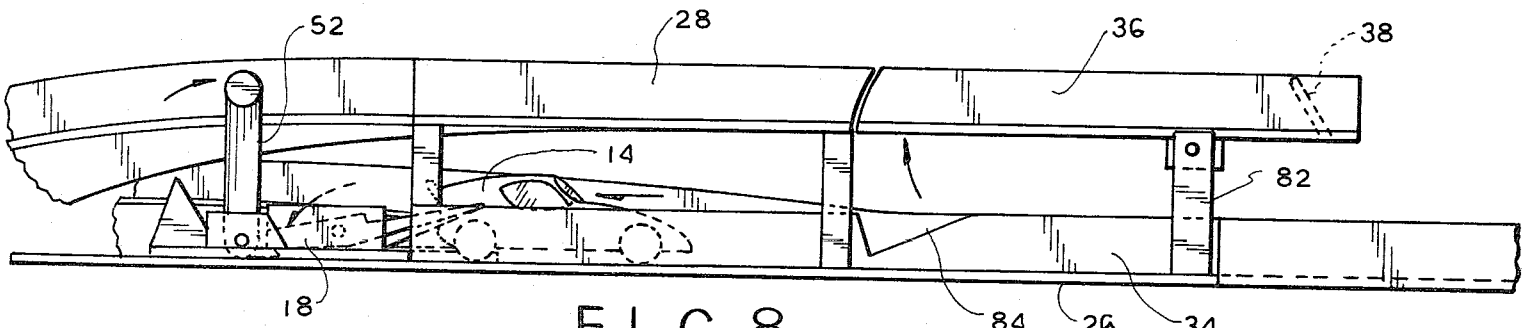
FIG. 8 is a side view similar to FIG. 7 showing the toy vehicle reengaged with the launcher in preparation for relaunch by the player.

The vehicle is guided into engagement with lever 44 by a tongue 70 formed as an extension of base 40. Tongue 70 passes between the rear wheels of the vehicle, as shown in FIG. 4, to insure that the vehicle is properly aligned with the lever. When wedge 62 engages the forward end 42*a* of housing 42, movement of the vehicle is stopped and the vehicle is in position for launching. In this position, the player presses down sharply on handle 52 in a counterclockwise direction, to quickly move the handle against the bias of spring 53 into the dotted line position shown in FIG. 4. This quick sharp motion drives lever 44 in a clockwise direction, from its solid line position to its dotted line position to apply a squeezing force against surface 66 of drive wedge 62, propelling the vehicle forwardly. The vehicle then enters the track, as shown in FIG. 2, and moves along the track until it completes its loop and moves up ramp section 30 onto end track section 36 in the end position of the track. As shown in FIGS. 5 and 6, end track section 36 has an abutment 38 which extends across the track to stop forward movement of the toy vehicle. Track section 36 is pivotally mounted by pins 80 or the like on pylons 82. The track section is balanced or weighted such that the abutment end of the track section is slightly heavier than the end to the right of pivot pins 80, as seen in FIG. 5. The adjacent ends 81, 83 of track section 36 and ramp 28 are shaped to engage each other and thereby cooperate to hold track section 36 normally in the horizontal position against counterclockwise movement beyond this horizontal position. Thus, section 36 is normally held in alignment with the remainder of the ramp section of the track so that it will receive the toy vehicle as it moves up the ramp. However, when the toy vehicle enters track section 36 the balance thereof is changed, and the weight of the toy vehicle causes track section 36 to pivot downwardly, in a counterclockwise direction, as seen in FIG. 7. This downward movement of track section 36 causes the toy vehicle to roll down the track section in the rearward direction, and back onto start section 26 of the track where it rolls backwardly into engagement with launcher 18. As seen in FIGS. 5–8, the sidewalls 34 of the track at the start position have notches 84 formed therein to permit the pivotal movement of track section 36 to the position shown, and to stop the pivotal movement at that position. Once the toy vehicle has moved off track section 36, the weight of the track section and its balancing causes it to return to its upper horizontal position, as shown in FIG. 8. As this occurs, the toy vehicle enters launcher 18 and the launcher can then be operated by the player to drive the vehicle in the forward direction.

Accordingly, it is seen that a relatively simply constructed toy vehicle game is provided which automatically returns the toy vehicles to their associated launchers so that they can be quickly and rapidly relaunched by a simple pivotal movement of handle 52. As a result, a very rapid action game is provided in which the players can continuously drive their vehicles about the track in a competitive race to determine who completes the required number of laps first. Of course, it will be appreciated that the toy vehicle and launcher arrangement can be used separately without the specific track construction shown in the drawings herein.

Although an illustrative embodiment of the invention has been described herein with reference to the accompanying drawings, it is to be understood that the invention is not limited to that precise embodiment, and that various other changes and modifications may be effected therein by one skilled in the art without departing from the scope or spirit of this invention.

What is claimed is:

1. A toy vehicle game including a track and toy vehicle for operation on the track, and means for launching the vehicle and propelling it along the track, said track including a start position at which said launcher is located and an end position located above said start position whereby a vehicle launched onto said track at said start position traverses the track to the end position above the start position, said track including a pivoted track section which is normally maintained in a horizontal position and which pivots when the vehicle enters it to deposit the vehicle onto the start position of the track to return the vehicle to the launching means.

2. A toy vehicle game as defined in claim 1 wherein said pivoted track section is arranged to return the vehicle in a reverse direction to said start position and into said launching means.

3. A toy vehicle game as defined in claim 2 wherein said toy vehicle has a wedge shaped element therein having its apex at the rear of the vehicle and said launching means comprises means for exerting a squeezing force on said wedge shaped element to propel said vehicle in a forward direction.

4. A toy vehicle race game including a track having a plurality of walls extending therealong and defining two separate race lanes of equal length, a pair of toy vehicles for independent operation in each lane and a pair of launchers for the vehicles associated with each of said lanes; said track including a pair of start positions and a pair of end positions, one for each lane, said end positions being defined by ramp sections in the respective track lanes positioned to locate said end positions above the start positions of their respective track lanes; said ramp sections each including a pivotally mounted track section normally maintained in a horizontal position to receive a toy vehicle entering it from the ramp section and to pivot, under the influence of the weight of a toy vehicle therein, to return the vehicle in a reverse direction downwardly back onto the start position of its associated lane and into its associated launcher whereby the vehicles are automatically returned to their associated launchers on each traverse of the track for respective launching by the players of the game.

5. A toy vehicle race game as defined in claim 4 wherein each of said toy vehicles has a wedge shaped drive element therein having an apex located at the rear of the vehicle and said launching means comprises means for applying a squeezing force to said wedge.

6. A toy vehicle as defined in claim 5 wherein said toy vehicles each include a body having a rear end including an opening therein; said wedge being contained within said body adjacent said opening whereby reverse movement of the vehicle from the pivoted track section causes said wedge to engage said launcher.

7. A toy vehicle game as defined in claim 6 wherein said launchers each include a first pivoted lever having one end positioned to engage the wedge of its associated vehicle and means for pivoting said first lever to urge said one end against the wedge and apply a squeezing force thereto.

8. A toy vehicle game as defined in claim 7 wherein said pivoting means comprises a second pivoted lever engaged with said first lever on the end thereof opposite said one end and having a handle for use for a player to pivot the second lever and thus the first lever to apply said squeezing force.

9. The combination comprising a toy vehicle and a launcher therefor, said toy vehicle including a body having a rear end with an opening therein, and a drive wedge mounted within the opening in said body and having a rearwardly positioned apex; said launcher including means for entering the opening in the rear end of the vehicle and applying a force to the wedge to drive said vehicle in a forward direction.

10. The combination as defined in claim 9 wherein said wedge has a flat horizontal surface along the bottom of the vehicle and an upper downwardly inclined surface joining said horizontal surface at said apex.

11. The combination as defined in either of claims 9 or 10 wherein said launcher includes a pivoted lever having a wedge shaped launching end for engaging the drive wedge in the vehicle and means for pivoting said lever when engaged with said drive wedge to apply said force to the vehicle's drive wedge to propel the vehicle forwardly.

12. The combination as defined in claim 11 wherein said pivoting means comprises a handle pivoted mounted in the launcher and operatively engaged with said lever to pivot the lever and apply said force.

13. The combination as defined in claim 10; wherein said means for entering the rear end of the vehicle engages with said upper downwardly inclined surface, and said launcher further includes second means for engaging with said flat horizontal surface such that said second means and said means for entering the rear end of the vehicle apply a squeezing force to the wedge to drive said vehicle in a forward direction.

14. The combination comprising a toy vehicle and a launcher therefor, said toy vehicle including a body having a rear end with an opening therein, and a drive wedge mounted within said opening and having at least one inclined surface; said launcher including means for entering the opening in the rear end of the vehicle and applying a squeezing force to the at least one inclined surface of the wedge to drive said vehicle in a forward direction.

* * * * *